US005122086A

United States Patent [19]

Remy

[11] Patent Number: 5,122,086

[45] Date of Patent: Jun. 16, 1992

[54] TOWABLE RIDING APPARATUS

[76] Inventor: Andrew P. Remy, 8220 Sandpiper Cir., Fort Worth, Tex. 76108

[21] Appl. No.: 573,590

[22] Filed: Aug. 24, 1990

[51] Int. Cl.[5] ..... B63H 7/08

[52] U.S. Cl. ..... 441/66; 114/345; 441/129

[58] Field of Search ..... 441/67, 123, 35, 40, 441/88, 65, 66, 80, 83, 129, 130, 131; D12/300, 316; 114/343, 345, 346, 361, 227, 267; 5/449, 455

[56] References Cited

U.S. PATENT DOCUMENTS

| | | | |
|---|---|---|---|
| 1,603,465 | 10/1926 | Hopkinson | 441/129 |
| 1,960,474 | 5/1934 | Browne | 441/129 |
| 2,748,401 | 6/1956 | Winstead | 441/129 |
| 3,030,640 | 4/1962 | Gosman | 441/129 |
| 3,056,980 | 10/1962 | Holladay | 441/129 |
| 3,490,085 | 1/1970 | Lewis | 114/345 |
| 3,670,349 | 6/1972 | Moore | 441/125 |
| 3,798,690 | 3/1974 | Moore | 114/357 |
| 4,406,628 | 9/1983 | Rademacher | 441/129 |
| 4,619,620 | 10/1986 | Felter | 441/66 |
| 4,689,844 | 9/1987 | Alivizatos | 441/129 |

FOREIGN PATENT DOCUMENTS

| | | | |
|---|---|---|---|
| 716162 | 1/1942 | Fed. Rep. of Germany | 441/40 |
| 1197364 | 7/1965 | Fed. Rep. of Germany | 280/18 |

*Primary Examiner*—Joseph F. Peters, Jr.
*Assistant Examiner*—Clifford T. Bartz
*Attorney, Agent, or Firm*—Geoffrey A. Mantooth

[57] ABSTRACT

A riding apparatus has a cover and plural inflatable tubes for towing several riders at once. The tubes are toroidally shaped and can be of the type used in vehicle tires. The cover has elongated, flexible top and bottom members coupled together at the sides. Plural cavities are formed between the top and bottom members. Each cavity matingly receives a tube. Each cavity communicates with the adjacent cavities so that each tube contacts the adjacent tubes at tangent points. The tangential points of contact between the tubes and the flexible top and bottom members coupling the tubes together allow each tube to pitch up and down with respect to the adjacent tubes. A towing harness is attached to the cover.

13 Claims, 3 Drawing Sheets

TOWABLE RIDING APPARATUS

FIELD OF THE INVENTION

The present invention relates to riding apparatuses in which human beings can ride in and which can be towed across the surface of water.

BACKGROUND OF THE INVENTION

Motorboats are widely used for towing people that ride on various devices. For example, a toroidally shaped inner tube may be towed behind a motorboat, carrying a person on top. The prior art has developed covers for encasing inner tubes. These covers, which are shown in U.S. Pat. Nos. 4,451,239 and 4,635,581 provide a means for attaching the tow rope from the motorboat and provide a closed bottom. The closed bottom of the prior art covers cause the inner tube to plane on top of the water and provide a supporting surface for the rider.

While prior art covers provide enjoyment, they are limited in use to a single adult rider. There is inadequate room in or on the inner tube for additional riders. A water sled has been developed to accommodate plural riders. The water sled has an inflatable, generally cylindrical tube. Two smaller tubes are located laterally along the main tube and are provided to stabilize against rolling motion. Plural riders straddle the main tube, which is towed from one end.

The problem with the prior art water sled is that the riders sit too high up. This destabilizes the water sled, so that unintentional rolling over is very common. Furthermore, a rider sitting along the tube is often crowded by the adjacent riders. Further still, the riders sit on the primary air envelope surface. If the air envelope surface leaks, it is repaired by patching. However, because the riders are in direct contact with this primary surface, the integrity of the patch may be threatened by rubbing, scraping, etc.

SUMMARY OF THE INVENTION

It is an object of the present invention to provide a riding apparatus that allows plural riders to be towed, while providing stability in the water.

It is a further object of the present invention to provide a riding apparatus that allows plural riders to be towed, while providing space between the riders for comfort.

The riding apparatus includes plural inflatable tubes, each of which are toroidal in shape and have sides, a top and a bottom. Top and bottom members each having side edges are coupled together at their side edges. The top and bottom members are elongated and have first and second ends. The top and bottom members are made of a flexible sheet-like material. The top and bottom members define a chamber that extends between the first and second ends. The chamber includes plural cavities that communicate with each other. Each of the cavities matingly receives one of the inflated tubes around a portion of the sides, the top and the bottom of the respective tube. Each of the tubes contacts its adjacent tubes at a tangent point on a side of the tube, wherein each of the tubes can pitch up and down with respect to its adjacent tubes, with the top and bottom members flexing. Harness means is provided for coupling towing means to the apparatus. The harness means is coupled to the first end of the top and bottom members.

In one aspect, the bottom member is provided with reinforcing means that extends from the first end towards the second end. The reinforcing means resists stretching of the bottom member when the riding apparatus is being used. The reinforcing means includes a strip of webbing that is stitched to the bottom member.

In another aspect, there is provided drain means in the bottom member for draining water out of the chamber of the cover. The drain means includes an opening in the bottom member, which opening is located near the second end. Screen means covers the opening and is coupled to the bottom member. Flap means is located exteriorly of the chamber and is coupled to the bottom member so as to cover the opening. The flap means is open in the direction of the second end so as to allow water to pass therethrough.

With the riding apparatus of the present invention, each rider is located in a separate tube. The tubes are located side by side so as to separate the riders for riding comfort. The wide beam provided by the outside diameters of the tubes which lay flat upon the water and the low center of gravity provide stability, making tipping difficult. The large planing surface provided by the bottom member distributes the load of riders over a large area, making towing easier.

Furthermore, with the riding apparatus of the present invention, each tube can pitch up and down somewhat independently of the adjacent tubes. The tubes pitch with hinge-like motions due to the tubes contacting at tangential points and due to the flexible cover coupling the tubes together. As the riding apparatus is towed across wavy water, the tubes pitch in an unpredictable manner, adding to the enjoyment of the riders.

Further still, the cover covers most of the tubes, surface areas, thereby protecting the inflatable tubes from puncture. The cover also covers and protects any patchwork used to repair leaks, by restricting direct contact with the tubes.

DESCRIPTION OF PREFERRED EMBODIMENT

Figure 1:
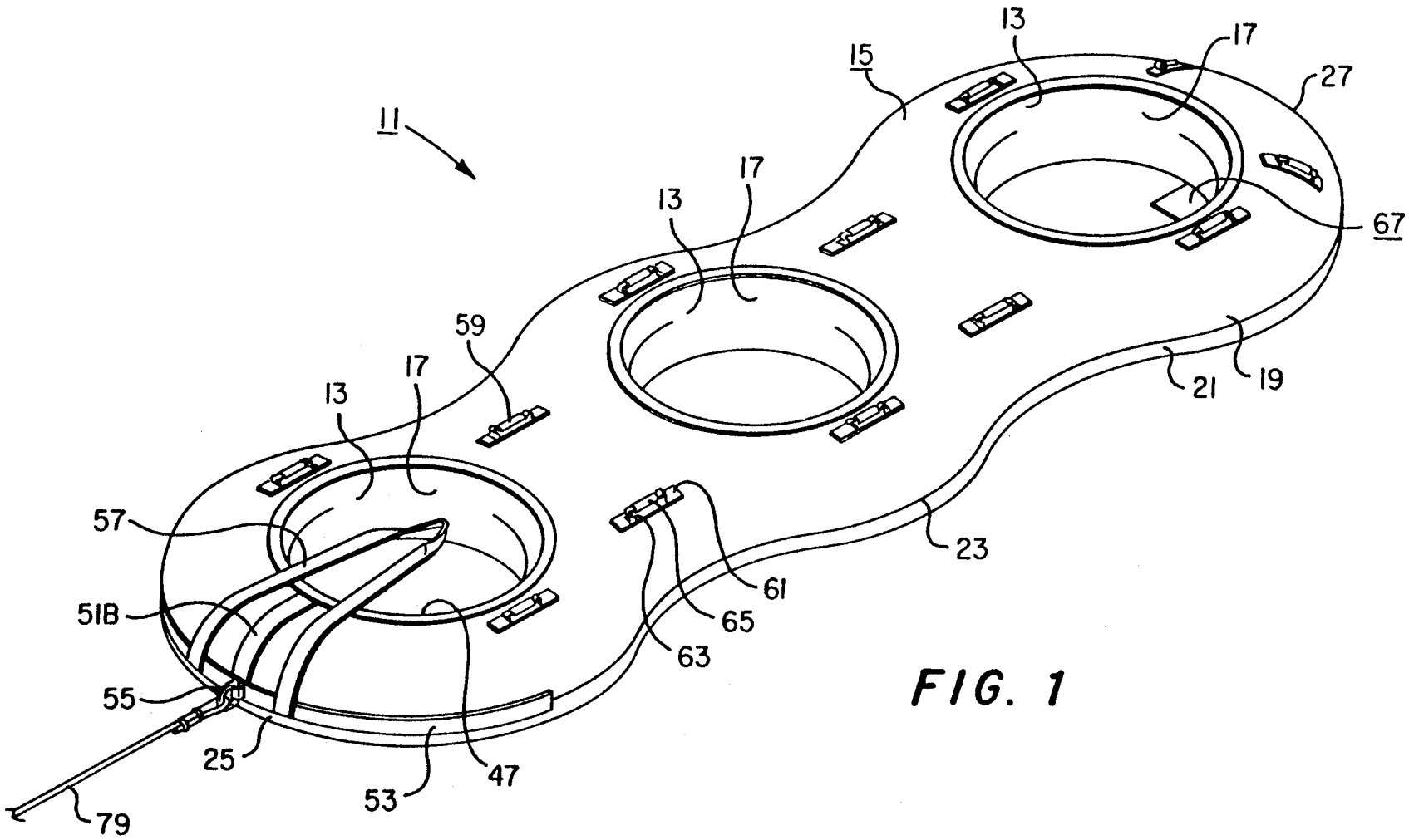
FIG. 1 is an isometric view of the riding apparatus of the present invention, in accordance with a preferred embodiment, shown with inflated tubes contained therein.

In FIG. 1, there is shown the towable riding apparatus 11 of the present invention, in accordance with a preferred embodiment. The riding apparatus 11 supports a number of people above the water as it is towed by a motorboat. The riding apparatus 11 includes plural inflatable tubes 13 and a cover 15.

Figure 3:
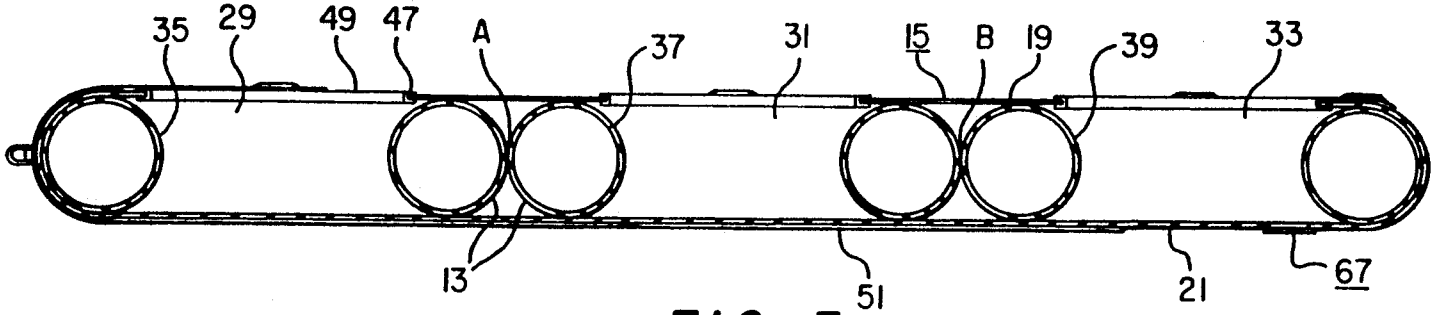
FIG. 3 is a longitudinal cross-sectional view, taken along lines III—III of FIG. 2.

The tubes 13 are toroidally shaped tubes such as are used in vehicle tires. Each tube therefore has a central opening 17, which opening receives a human rider. The tubes are circular in plan view, as shown schematically in FIG. 5. As shown in FIG. 3, the cross-section of the toroidal tubes is also circular. As such, each tube has rounded sides, and rounded top and bottom surfaces.

The tubes are inflated and deflated by way of a recessed valve (not shown). The tubes are typically made of rubber (either natural or synthetic) and are commercially available.

Figure 2:
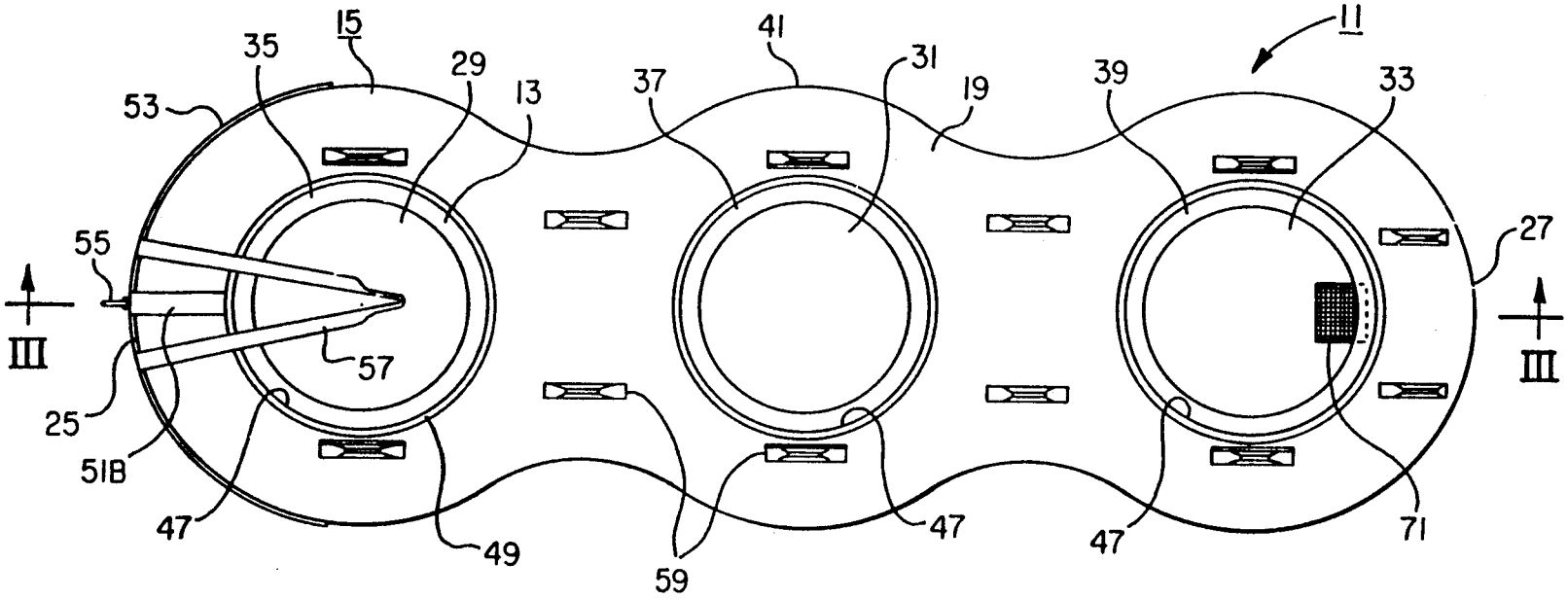
FIG. 2 is a top view of the apparatus of FIG. 1.
Figure 5:
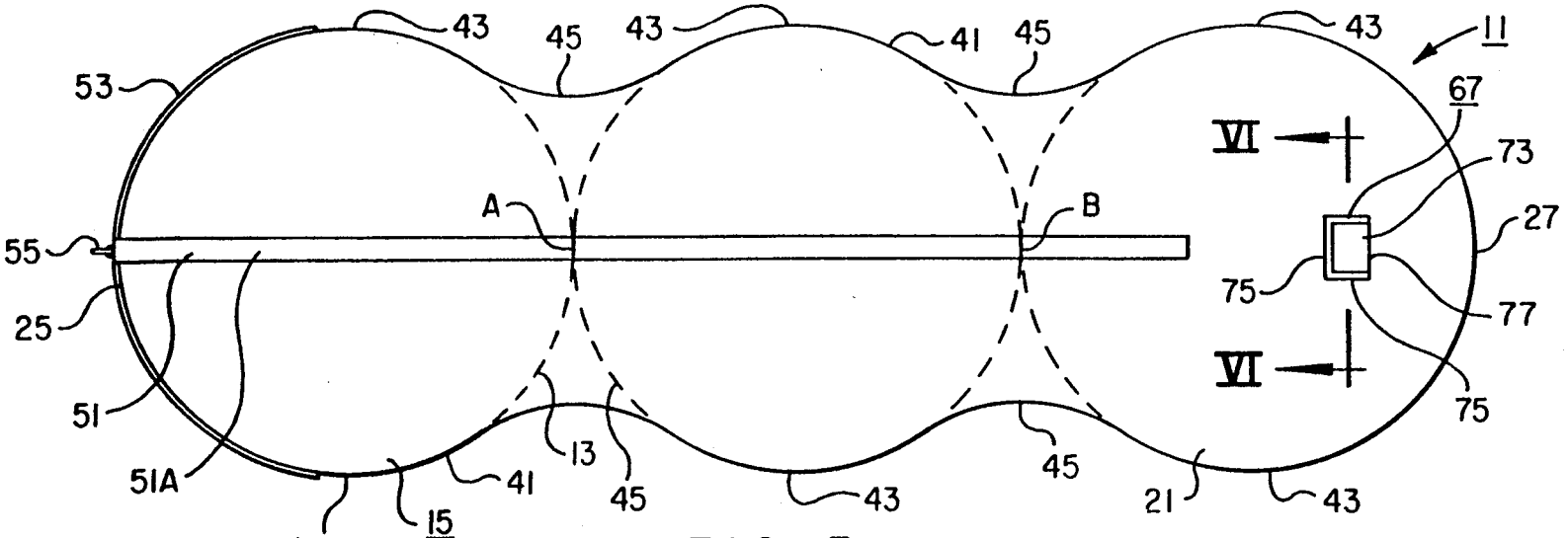
FIG. 5 is a bottom view of the apparatus of FIG. 1.

Referring to FIGS. 1, 2 and 5, the cover 15 is formed from elongated top and bottom members 19, 21. The top and bottom members 19, 21 are each made of a flat, sheet-like material that is flexible and durable. In the preferred embodiment, the top and bottom member are made of 14 ounce vinyl. The side edges of the top and bottom members 19, 21 are stitched together along a seam line 23. The seam line 21 extends around the entire perimeter of the top and bottom members 19, 21. The stitching is done in accordance with conventional practice, wherein the seam is located on the inside of the cover. The assembled cover 15 has front and rear ends 25, 27.

Inside of the cover are plural cavities 29, 31, 33 (see FIGS. 2 and 3); each cavity matingly receives one of the inflated tubes 13. The cavities are located between the top and bottom members and are positioned one after another in a linear arrangement between the front and rear ends 25, 27 of the cover. In the embodiment shown in the drawings, there are three cavities. Thus, there is a front cavity 29, an intermediate cavity 31 and a rear cavity 33. These cavities receive corresponding front, intermediate and rear tubes 35, 37, 39. The tubes are matingly received by the cavities such that the cover contacts portions of the top, bottom and side surfaces of each tube. Each cavity communicates with the respective adjacent cavities. Thus, the front and intermediate cavities 29, 31 communicate with one another and the intermediate and rear cavities 31, 33 communicate with one another. Cumulatively, the front, intermediate and rear cavities form a single elongated chamber extending from the front end to the rear end 25, 27. As shown in FIGS. 3 and 5, when all the tubes are located within the cover, each tube contacts the adjacent tube or tubes at tangent points A, B. Thus, the front and the intermediate tubes 35, 37 contact at a tangent point A, and the intermediate and the rear tubes 37, 39 contact at a tangent point B.

Referring to FIG. 5, the cover 15 has undulating sides 41 that extend between the front and rear ends 25, 27. The undulations are caused by the mating fit of the cover to the tubes. The widest portions 43 of the cover are located at the widest potions of the tubes while the narrowest portions 45 of the cover are located near the contact points A, B between adjacent tubes.

Figure 4:
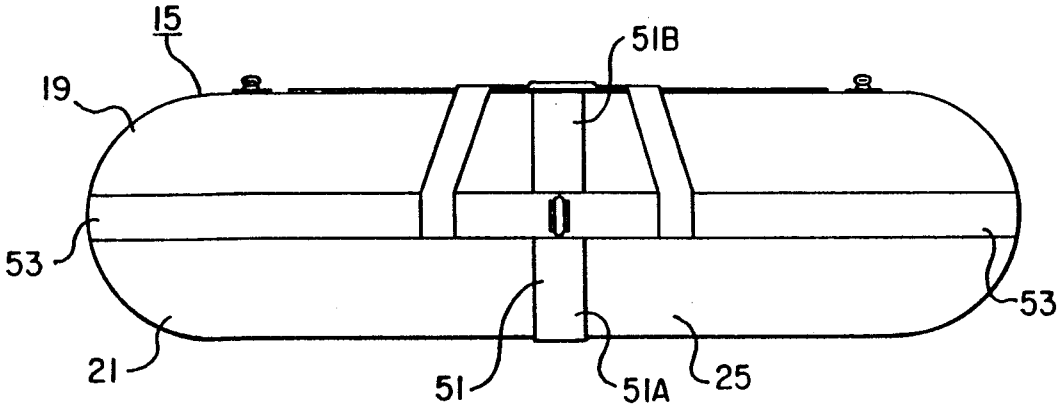
FIG. 4 is a front view of the apparatus of FIG. 1.

The top member 19 has circular openings 47 located concentrically with the openings 17 of the respective tubes (see FIGS. 2 and 3). The openings 47 in the top member allow a rider to sit inside of the tube opening 17. Webbing 49 is stitched to the edge of each opening for reinforcement The cover 15 has a length of webbing 51 stitched along its longitudinal axis from the front end 25 to almost the rear end 27, as shown in FIGS. 4 and 5. The longitudinal webbing 51, which is made of woven polypropylene, prevents the cover from stretching when the riding apparatus is being towed with riders. The webbing is in two segments: one segment 51A is stitched to the bottom member 21 and the other segment 51B is stitched to the top member 19 and extends to the opening 47 of the front cavity 29 (see FIG. 2).

The front end 25 of the cover 15 is provided with a length of reinforcing webbing 53 extending laterally from each side of the longitudinal webbing 51 for about 90 degrees of the circumference of the front tube 35 (see FIGS. 2, 4 and 5). A "D" ring 55 is stitched to the lateral webbing 53. The "D" ring 55 and the associated webbing 51, 53 make up a towing harness that distributes the towing forces along the cover 15.

Referring to FIG. 1, there is also provided a flexible handle 57 at the front end 25. The handle 57 is used by a human rider in the front cavity 29. The handle is made by stitching both ends of a length of webbing to the front end 25 of the top member 19. The ends of the handle 57 are stitched to the top member from the lateral webbing 53 to the opening 47. Plural handles 59 are provided on the top member, which handles are located to the sides of each opening 47 and between adjacent openings. The handles may be used as handholds for the riders and for manipulating the riding apparatus 11 in and out of the water. As shown in FIG. 1, each handle has a base 61 and a loop 63, both of which are made of webbing. The base 61 is stitched to the top member 19. The loop 63 has both ends stitched to the base 61 into the top member so as to form a loop. The unstitched portion of the loop extends through a length of soft plastic tubing 65.

Figure 6:
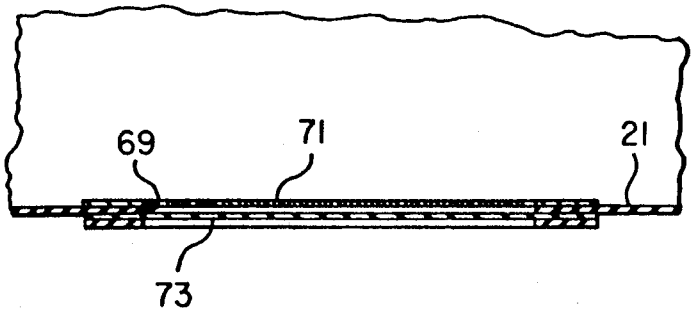
FIG. 6 is a transverse cross-sectional view, taken along lines VI—VI of FIG. 5.

Referring to FIG. 2, 5 and 6, a drain 67 is provided in the bottom member 21 near the rear end 27. The drain 67 is formed by cutting a rectangular opening 69 in the bottom member 21. A screen 71 covers the opening 69 to prevent objects from falling through. A flap 73 is provided on the bottom side of the bottom member 21. The flap is stitched to the bottom member on three edges 75, namely the front and side edges. The rear edge 77 is left open to allow water to drain out. By orienting the flap opening aftwardly or rearwardly, forward motion of the riding apparatus across water will not force water into the interior of the cover.

Because of the flexible nature of the top and bottom members 19, 21, the cover can be easily folded up for storage. To use the cover 15, it is unfolded and laid out. Then, the uninflated tubes 13 are inserted into the respective cavities by way of the openings 47. The tubes are then inflated to the desired pressure. One inflated, the cover matingly fits around the tubes, thereby preventing any movement of the tubes within the cover. The adjacent tubes touch at the tangent points A, B.

A tow rope 79 is attached to the cover at the ring 55. The human riders sit inside of the cavities 29, 31, 33 on the bottom member 21 and within the openings 17 of the respective tubes.

The riding apparatus of the present enhances riding enjoyment because of the hinge-like arrangement between adjacent tubes that is due to the flexibility of the cover 15 and the tangential points A, B of contact between the tubes 13. This hinge-like arrangement allows the adjacent tubes. This flexibility of tube movement comes into play when the riding apparatus is towed across waves. Each tube follows the waves somewhat independently of the other tubes. The result is wild and unpredictable pitching motions of the tubes and the riders therein.

Unlike the prior art, which tows several riders high off of the water, the riding apparatus of the present invention has a low center of gravity, thereby making it extremely stable. The riders sit low and inside of the cavities. The tubes, at their widest diameters, provide the riding apparatus with a wide beam for stability. Furthermore, the bottom member provides a large surface area that enhances the planing ability of the riding apparatus. This enables the apparatus to plane more easily on top of the water, making the apparatus easier to tow.

The foregoing disclosure and the showings made in the drawings are merely illustrative of the principles of the invention and are not to be interpreted in a limiting sense.

I claim:

1. A riding apparatus, comprising:

a) an elongated bottom wall having first and second ends;

b) an elongated top wall located adjacent to said bottom wall;

c) side walls extending between said bottom and top walls so as to connect said bottom and top walls together, said bottom, top and side walls being made of a flexible material;

d) plural cavities located within said top, bottom and side walls, said cavities being linearly arranged so as to extend from said first end to said second end, each of said cavities being adapted to matingly receive an inflatable member such that said inflatable members are retained in said respective cavities by said top, bottom and side walls, each of said cavities communicating with the adjacent cavities such that each of said respective received inflatable members can contact the adjacent inflatable members in said adjacent cavities at respective contact points, wherein said flexible top, bottom and side walls allow each of said inflatable members to move about said respective contact points with respect to said adjacent inflatable members, with the movement of said inflatable members being in plural opposite directions with respect to a water line of said riding apparatus;

e) harness means coupled to said first end, said harness means being adapted for coupling towing means to said apparatus, wherein said riding apparatus can be towed with human riders located thereon.

2. The riding apparatus of claim 1 wherein said bottom wall further comprises reinforcing means extending form said first end towards said second end, said reinforcing means resisting stretching of said bottom wall when said riding apparatus is used, said reinforcing means being coupled to said bottom wall.

3. The riding apparatus of claim 2 wherein said reinforcing means comprises a strip of webbing stitched to said bottom wall.

4. The riding apparatus of claim 1 wherein said bottom wall further comprises drain means for draining water out of said cavities.

5. The riding apparatus of claim 1 wherein said top wall further comprises plural openings, there being an opening for each cavity, said openings for receiving human riders so that said riders can be located within said cavities.

6. The riding apparatus of claim 1 further comprising:

a) reinforcing means extending from said first end towards said second end, said reinforcing means for resisting stretching of said bottom wall when said riding apparatus is used, said reinforcing means comprising a strip of webbing stitched to said bottom wall;

b) drain means for draining water out of said cavities;

c) said top wall further comprising plural openings, there being an opening for each cavity, said openings for receiving human riders so that said riders can be located within said cavities.

7. A riding apparatus, comprising:

a) plural inflatable tubes, each of said tubes being toroidal in shape and having sides, a top and a bottom;

b) top and bottom members each having side edges, said top and bottom members being coupled together at their side edges, said top and bottom members being elongated and having first and second ends, said top and bottom members being made of a flexible sheet-like material;

c) said top and bottom members defining plural cavities that extend between said first and second ends, each said plural cavities communicating with the adjacent cavities, each of said cavities matingly receiving one of said inflatable tubes around a portion of the sides, the top and the bottom of said respective tubes, said top and bottom members retaining said inflatable tubes in said respective cavities;

d) each of said tubes contacting its adjacent tubes at a respective tangent point on the side of said tube, wherein said flexible top and bottom members allow each of said tubes to move about said respective tangent points with respect to said respective adjacent tubes, with the movement of said tubes being in plural opposite directions with respect to a water line of said riding apparatus;

e) harness means coupled to said first end of said top and bottom members, said harness means being adapted for coupling towing means to said apparatus, wherein said riding apparatus can be towed with human riders located thereon.

8. The riding apparatus of claim 7 further comprising drain means for draining water out of said cavities, said drain means being located in said bottom member.

9. The riding apparatus of claim 8 wherein said drain means comprises:

a) an opening in said bottom member, said opening being located near said second end;

b) screen means covering said opening and being coupled to said bottom member;

c) flap means being located exteriorly of said cavities and covering said opening, said flap means being coupled to said bottom member so as to open in the direction of said second end.

10. The riding apparatus of claim 7 wherein said cover further comprises reinforcing means extending from said first end towards said second end, said reinforcing means for resisting stretching of said cover when said riding apparatus is used, said reinforcing means being coupled to said bottom member.

11. The riding apparatus of claim 10 wherein said reinforcing means comprises a strip of webbing stitched to said bottom member.

12. The riding apparatus of claim 7 wherein said top member comprises plural openings, there being an opening for each cavity, said openings for receiving human riders so that said riders can be located within said cavities.

13. The riding apparatus of claim 7, further comprising:

a) drain means for draining water out of said cavities, said drain means comprising:

i) an opening in said bottom member, said opening being located near said second end;

ii) screen means covering said opening and being coupled to said bottom member;

iii) flap means being located exteriorly of said cavities and covering said opening, said flap means being coupled to said bottom member so as to open in the direction of said second end;

b) reinforcing means extending from said first end towards said second end, said reinforcing means for resisting stretching of said cover when said riding apparatus is used, said reinforcing means comprising a strip of webbing stitched to said bottom member;

c) said top member further comprises plural openings, there being an opening for each cavity, said openings for receiving human riders so that said riders can be located within said cavities.

* * * * *